US008104416B1

(12) United States Patent
Shivers, III et al.

(10) Patent No.: US 8,104,416 B1
(45) **Date of Patent: *Jan. 31, 2012**

(54) FLOATING NATURAL GAS PROCESSING STATION

(75) Inventors: Robert Magee Shivers, III, Houston, TX (US); William T. Bennett, Jr., Houston, TX (US); David Trent, Houston, TX (US)

(73) Assignee: ATP Oil & Gas Corporation, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/025,477

(22) Filed: Feb. 11, 2011

(51) Int. Cl.

| | |
|---|---|
| ***B63B 21/00*** | (2006.01) |
| ***B63B 22/02*** | (2006.01) |
| ***B63B 22/26*** | (2006.01) |
| ***B63B 25/08*** | (2006.01) |
| ***B63B 35/44*** | (2006.01) |
| ***F17C 7/02*** | (2006.01) |
| ***F25J 1/00*** | (2006.01) |

(52) U.S. Cl. ..... 114/230.14; 114/230.15; 114/230.17; 114/264; 441/5; 62/50.1; 62/611; 141/387

(58) Field of Classification Search ..... 114/230.1, 114/230.13–230.18, 74 R, 264; 441/3–5; 62/50.1–50.7, 611–614, 53.2; 137/615; 141/279, 141/387, 388; 414/137.1–138.2
See application file for complete search history.

(56) References Cited

U.S. PATENT DOCUMENTS

| | | | | |
|---|---|---|---|---|
| 3,155,069 | A * | 11/1964 | Ross et al. | 114/230.19 |
| 4,041,721 | A * | 8/1977 | Kniel | 62/53.2 |
| 4,315,533 | A * | 2/1982 | Eagles | 141/387 |
| 4,494,475 | A * | 1/1985 | Eriksen | 114/230.14 |
| 4,735,167 | A * | 4/1988 | White et al. | 114/230.14 |

* cited by examiner

*Primary Examiner* — Ajay Vasudeva
(74) *Attorney, Agent, or Firm* — Buskop Law Group, PC; Wendy Buskop

(57) ABSTRACT

A floating natural gas processing station for receiving dry gas and forming liquefied natural gas for offloading is disclosed herein. The station can use a station heat exchanger, a natural gas liquefaction train, and an offloading device having a primary quick connect/disconnect device, a secondary emergency disconnect device, and a tertiary emergency disconnect device to allow quick connect/disconnect or emergency disconnect of the floating natural gas processing station from a transport vessel. At least two telescoping mooring arms with a boom and a jib in a nested arrangement can hold the transport vessel at a nominal distance from the floating natural gas processing station, while forming a gangway to safely move personnel and loads between the floating natural gas processing station and the transport vessel.

20 Claims, 12 Drawing Sheets

FLOATING NATURAL GAS PROCESSING STATION

FIELD

The present embodiments generally relate to a floating natural gas processing station.

BACKGROUND

A need exists for a configured moveable floating natural gas processing station.

A need exists for floating station configured to dynamically react to environmental conditions, such as wind and waves, to extend and retract a jib to maintain a stable distance between the floating natural gas processing station and a transport vessel, while allowing the transfer of people, loads of materials, and equipment in a gangway, and while allowing transfer of an on-board processed liquefied natural gas and a return of a hydrocarbon vapor for processing and for fueling the floating natural gas processing station.

A further need exists for a floating natural gas processing station with a quick connect and release configured to quickly connect transport vessel to the floating natural gas processing station and to provide emergency release of the transport vessels from the floating natural gas processing station simultaneously while offloading fluid and return hydrocarbon vapor.

A need exists for a floating natural gas processing station that can extend a device or retract a device to a minimum or maximum extension or retraction depending on seas, weather conditions, and a size of the transport vessel, thereby maintaining a nominal distance between the floating natural gas processing station and the transport vessel.

A need exists for a floating natural gas processing station that can cease flow of fluid between the floating natural gas processing station and the transport vessel for safety in anticipation of a major storm, such as a hurricane or a 100 year storm.

The present embodiments meet these needs.

BRIEF DESCRIPTION OF THE DRAWINGS

The detailed description will be better understood in conjunction with the accompanying drawings as follows.

Figure 1A:
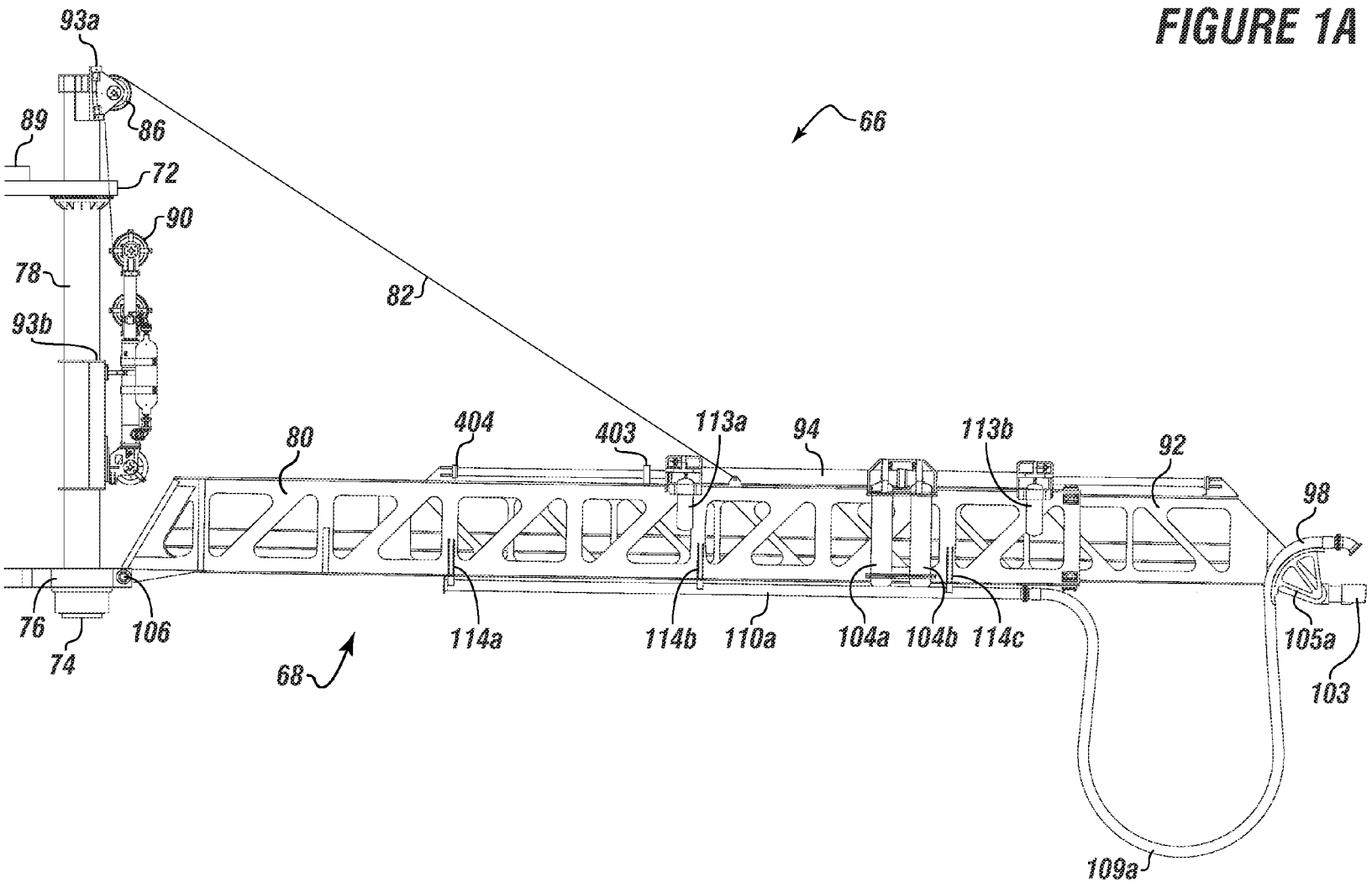
FIG. 1A depicts a first side view of a soft yoke with a boom in a second position for use on a floating station to maintain a transport vessel apart from the floating station.

The present embodiments are detailed below with reference to the listed Figures.

DETAILED DESCRIPTION OF THE EMBODIMENTS

Before explaining the present system in detail, it is to be understood that the station is not limited to the particular embodiments and that it can be practiced or carried out in various ways.

The present embodiments generally relate to a natural gas processing station with a soft yoke.

The natural gas processing station can have a station hull and a plurality of mooring lines connecting the station hull to a seabed. The station hull can have a variable draft.

A dry gas inlet conduit can receive a dry gas, such as from a pretreatment source, and can flow the dry gas to a station heat exchanger on the natural gas processing station for cooling the dry gas.

A liquefaction train, or natural gas liquefaction train, can act as a refrigerant for the station heat exchanger. The station heat exchanger can form a liquefied natural gas from the dry gas. The natural gas liquefaction train can be a dual expansion nitrogen cycle assembly, another natural gas liquefaction train, a single mixed refrigerant, a dual mixed refrigerant, or a cascade refrigerant.

An offload flexible outlet conduit can flow the liquefied natural gas from the station heat exchanger and/or the liquefaction train to the soft yoke, and then to a transport vessel. The liquefied natural gas can then be offloaded onto the transport vessel, such as into storage tanks.

A vapor return flexible conduit can communicate hydrocarbon vapor formed during offloading of the liquefied natural gas onto the transport vessel. The vapor return flexible conduit can communicate the hydrocarbon vapor from the transport vessel to the floating natural gas processing station.

One or more quick connect/disconnects and emergency connect/disconnects can provide connection between the soft yoke and transport vessels.

A station controller can be used for monitoring the dry gas inlet conduit, the station heat exchanger, and the offload flexible outlet conduit, and for actuating a primary quick connect/disconnect connector, a secondary emergency disconnect connector, and a tertiary emergency disconnect/connector.

The station controller can be a computer system connected to various transducers, or sensors for monitoring the receipt, storage, and offloading of the processed liquefied natural gas. The station controller can monitor torque on mooring arms of the soft yoke. The station controller can monitor a dry gas inlet flow rate, a dry gas temperature, and a dry gas pressure.

The station controller can compare the monitored data, including rates, to preset limits in a data storage of the station controller. The station controller can also have a processor that can be in communication with the data storage. The station controller can have computer instructions that send alarms to operators when the monitored flow rates and other data fall below or exceed preset limits in the data storage.

The station controller can control the dry gas inlet conduit, such as by being connected to emergency shut off devices.

The station controller can monitor the station heat exchanger by monitoring rates of temperature, flow rates of pre-cooled gas, as well as temperature and flow rates of refrigerant used in the station heat exchanger.

The station controller can monitor the outlet conduits by monitoring the vapor return rates, temperatures, and pressures. For example, the station controller can monitor a loading rate, a station draft, a temperature, a processed tonnage, a station trim, and motions.

The station controller can compare real-time data to stored data in the data storage associated with the processor, and can send off alarms if the loading rates, pressures, or temperatures exceed or drop from within predefined limits for a certain weather condition, such as having excessive pitch, yaw, roll, surge, sway, and heave during a 20 knot gale.

The floating natural gas processing station can have a station keeping device for providing dynamic positioning to the floating natural gas processing station, such as by using GPS coordinates or preset distances from transport vessels that arrive to receive the liquefied natural gas.

The floating natural gas processing station can maintain each transport vessel at a safe but workable distance from the floating natural gas processing station to permit safe offloading of personnel, gear, and safe offloading of liquefied natural gas. Also, the system can permit the safe return of the hydrocarbon vapor formed during offloading.

The offloaded vapor can flow to the station heat exchanger to be cooled, and can be used as a fuel to run the floating natural gas processing station. The station heat exchanger can be a cold box or a spiral wound heat exchanger. Multiple heat exchangers can be used in series on the floating natural gas processing station. For example, the floating natural gas processing station can be configured to use the hydrocarbon vapor that is formed during loading of the liquefied natural gas to power generators that power the floating natural gas processing station.

The floating natural gas processing station can have a station hull formed from three or more columns with a deck and optional crews quarters. The columns can be ballasted columns for use in water, such as water with a depth of about 200 feet or more.

The floating natural gas processing station can be connected to or in fluid communication with a pretreatment source that can pre-treat natural gas through dehydration. The pretreatment source can be on another vessel or platform.

The pretreatment source can have a dehydrator for removing water from the natural gas. The pretreatment source can have a heat exchanger that can cryogenically cool the dehydrated gas or dry gas to a first cool temperature before transferring the cooled dry gas to the floating natural gas processing station.

In one or more embodiments, the station hull can be a semi-submersible hull, or another type of hull. The floating natural gas processing station can be spread moored using from about 8 mooring lines to about 12 mooring lines. The mooring lines can be wire rope, chain and wire rope, or similar material, and can be used for mooring to anchors in the sea bed, such as suction pile anchors.

The floating natural gas processing station can have a spread moored turret connected to the station hull. The mooring lines can connect to the spread moored turret, allowing the floating natural gas processing station to weather vane. The inlet conduit can communicate through the spread moored turret to flow the dry gas or cool dry gas from the pretreatment source to the floating natural gas processing station.

The dry gas can be primarily methane with small amounts of ethane, propane, butane, and less than 10 percent heavier components. At least 65 percent of acid gas and water vapor can be removed from the dry gas, such as at the pretreatment source.

The pretreatment source can be a floating or fixed platform with a bulk separator to remove liquid from the natural gas, an acid gas removal unit to remove acid, a dehydrator to remove water vapor, and a cryogenic plant to remove heavier hydrocarbons, such as pentane, propane, and butane, and to cool the dry gas.

The flexible outlet conduit of the floating natural gas processing station can be flexible and can lengthen or shorten depending on weather conditions and spacing needed between transport vessels and the floating natural gas processing station.

The flexible outlet conduit can have a sensor that can connect to the station controller to monitor temperatures, pressures, and flow rates of the fluid flow of the liquefied natural gas.

The floating natural gas processing station can include a soft yoke with at least one telescoping mooring arm adapted to connect any one of a variety of shapes and sizes of transport vessel to the floating liquefied natural gas processing station. The soft yoke can accomplish this versatile connection by using two telescoping mooring arms. The soft yoke can be made of steel, aluminum, a composite, or another structural material.

The soft yoke can have various functions. For example, the soft yoke can function to maintain the transport vessel a nominal distance from the station.

The telescoping mooring arms can each have a length from about 50 feet to about 150 feet, and a width from about 7 feet to about 14 feet. However, the size of the telescoping mooring arms can be different depending upon the particular application. The telescoping mooring arms can be perforated, allowing wind to flow through the telescoping mooring arms so that excessive pressure does not build on the telescoping mooring arms by high winds. In one or more embodiments, a stiffness of the telescoping mooring arm can operate within a range from about 2.5 tons per foot to about 10 tons per foot.

Each telescoping mooring arm can have an upper connecting mount for engaging the soft yoke to the floating natural gas processing station. The upper connecting mount can be a rotational mount and can include a gear for rotating the soft yoke relative to the floating natural gas processing station.

Each soft yoke telescoping mooring arm can have a lower connecting mount for engaging the soft yoke to the floating natural gas processing station. The lower connecting mount can be a rotational mount and can include a gear for rotating the soft yoke relative to the floating natural gas processing station.

Each soft yoke telescoping mooring arm can have a turn table connected to the lower connecting mount, which can provide a walking surface and a pivoting structural anchoring point for a boom.

Each soft yoke telescoping mooring arm can have a king post engaged with the turn table and the upper connecting mount. The turn table can be configured to rotate with the king post.

Each telescoping mooring arm can have a boom connected to the turn table and to at least one wire or luffing wire. The boom can be pivotably connected to the turn table.

The luffing wires can be made of composite fiber or steel. Each luffing wire can be engaged with a turn down sheave, which can be mounted to the king post. Each luffing wire can also be engaged with a tensioner.

The tensioner can be a hydraulic cylinder accumulator assembly, which can function as a pneumatic tensioning device for the luffing wire. The tensioner can be configured to apply tension to and release tension from the luffing wires, which can connect to a jib. Slack can be provided to luffing wires that engage between the jib and tensioners.

The jib can be telescopically disposed within the boom. The jib can have a length from about 50 feet to about 100 feet, and a width from about 7 feet to about 14 feet. The jib can be connected to at least one centralizing cylinder, which can be a hydraulic cylinder accumulator assembly.

The centralizing cylinders can operate to control a position of the jib within the boom. For example, the centralizing cylinders can be configured to extend and retract the jib relative to the boom. The centralizing cylinders can have a capacity ranging from about 200 psi to about 2000 psi, or any psi depending upon the application.

The jib can extend out of an end of the boom, and can retract into the boom. The jib can slide within the boom. The extension and retraction of the jib can be adjusted to account for wave motion, current motion, wind motion, transport vessel dynamics, floating natural gas processing station dynamics, changes in draft, other motions, and other such variables. As such, the jib can be operated to maintain a nominal standoff position within preset limits for holding the transport vessel within predefined distances from the floating natural gas processing station.

The soft yoke can extend up to any length required to maintain a predefined distance between the transport vessel and the floating natural gas processing station, for example from +/−5 feet to +/−30 feet.

The boom and jib can be in a nested arrangement, forming an enclosed gangway with openings. The enclosed gangway can support movement of personnel and equipment up to 800 pounds between the transport vessel and the floating natural gas processing station.

Each telescoping mooring arm can have one or more conduits, including a soft yoke offload conduit for communicating fluid from the floating natural gas processing station to the transport vessel for loading the liquefied natural gas thereon.

In operation, once a transport vessel is connected to the floating natural gas processing station, the soft yoke offload conduit can be in fluid communication with one or more storage tanks on the transport vessel, and the fluid, such as liquefied natural gas, can pumped from the floating natural gas processing station to the transport vessel.

Each telescoping mooring arm can have a soft yoke vapor return flexible conduit for communicating vapor formed during offloading of the fluid back to the floating natural gas processing station for use in running the floating natural gas processing station.

The soft yoke can have a primary quick connect/disconnect connector, a secondary emergency disconnect connector, and a tertiary emergency disconnect connector that can be used simultaneously with the offloading of the processed natural gas.

Figure 1B:
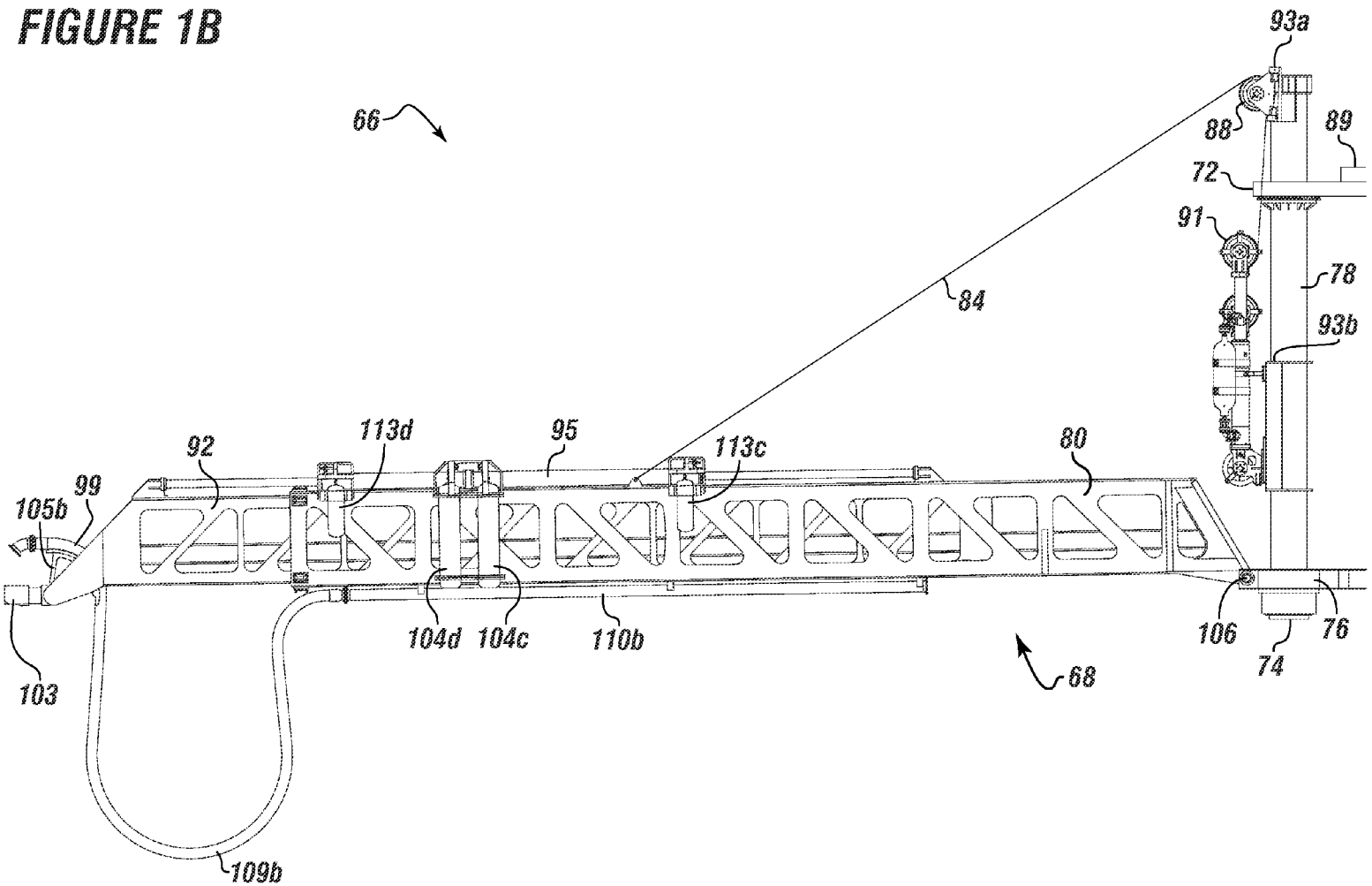
FIG. 1B shows a second side view of the soft yoke with the boom in the second position.

FIG. 1A depicts a side view of a soft yoke 66 with a first telescoping soft yoke mooring arm 68. FIG. 1B shows the opposite side of the soft yoke 66 shown in FIG. 1A.

Referring now to both FIGS. 1A and 1B, the first telescoping soft yoke mooring arm 68 can include an upper connecting mount 72 for engaging a floating natural gas processing station, a fixed or floating vessel, a floating structure, or the like.

The first telescoping soft yoke mooring arm 68 can include a lower connecting mount 74 for engaging the floating natural gas processing station, fixed or floating vessel, floating structure, or the like.

The upper connecting mount 72 and the lower connecting mount 74 can have a diameter from about 48 inches to about 84 inches, and can be made of powder coated steel.

The first telescoping soft yoke mooring arm 68 can be actuated by a soft yoke controller 89, which can be in communication with a station controller (shown in FIG. 3A), or the first telescoping soft yoke mooring arm 68 can be actuated by the station controller.

The soft yoke 66 can include a turn table 76 connected to the lower connecting mount 74. The dimensions of the turn table 76 can be from about 9 feet to about 12 feet in diameter. The turn table 76 can have a thickness from about 12 inches to about 24 inches, and can be made of steel with an internal bearing of bronze or another frictionless material.

The soft yoke 66 can include a king post 78 that engages with the turn table 76, the upper connecting mount 72, and the lower connecting mount 74. The turn table 76 can be configured to rotate with the king post 78. The king post 78 can be connected to a first tensioner 90 and a second tensioner 91 by a tensioner mount 93*b*.

The king post 78 can be made of steel, and can have a length of from about 12 feet to about 50 feet and a diameter from about 3 feet to about 6 feet. The king post 78 can be a rolled tube with a hollow portion.

The soft yoke 66 can have a boom 80 connected to the turn table 76. The boom 80 can have a length from about 40 feet to about 140 feet, a height from about 8 feet to about 14 feet, and a width from about 8 feet to about 16 feet.

In embodiments, the boom 80 can be a tubular. The boom 80 can have a diameter from about 14 feet to about 16 feet. The boom 80 can include hollow tubulars welded together to reduce cost in shipping. The boom 80 can be configured to not fail upon impacts and slams, which can occur to the floating natural gas processing station to which the boom 80 is attached. For example, the boom 80 can be configured to not fail upon impacts and slams during a 20 year storm, according the US Coast Guard classification of a 20 year storm with wave sizes of up to 12 feet and a frequency of from about 2 feet to about 3 feet.

A heel pin 106 can connect the boom 80 to the turn table 76, allowing the boom 80 to rotate relative to the turn table 76. A typical heel pin can be machined from cold drawn high strength steel shafting, and can have a length from about 6 inches to about 18 inches and a diameter from about 6 inches to about 12 inches. The boom 80 can be locked into the turn table 76 using a collet and locking pin.

Figure 1C:
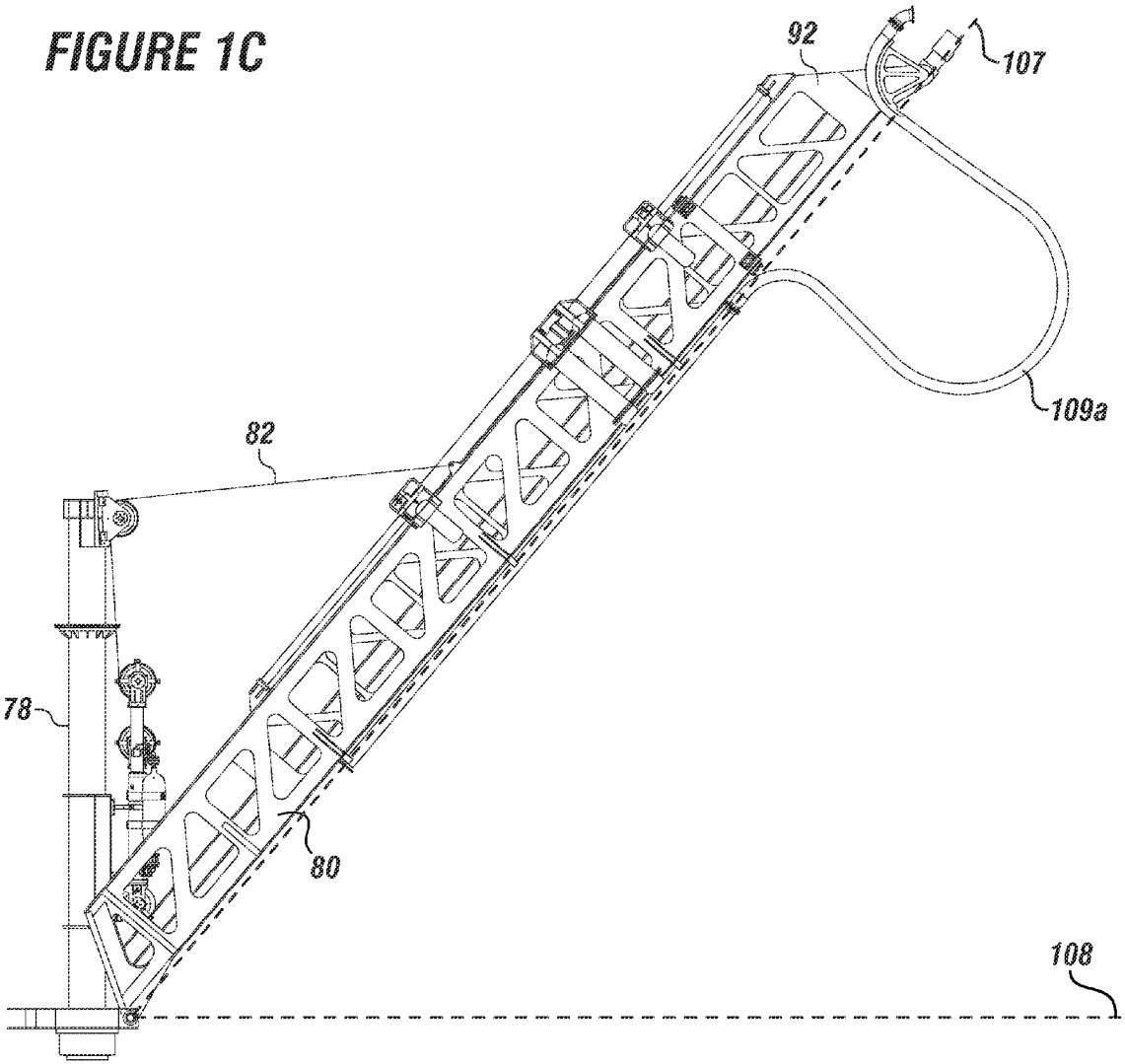
FIG. 1C shows a side view of the soft yoke in a first retracted position.

As such, the boom 80 can pivot from a first position, such as with the boom 80 extending to a substantially parallel position with the king post 78 (which is shown in FIG. 1C at about a 45 degree angle), to a second position, such as with the boom 80 extending substantially perpendicular to the king post 78. The boom 80 can pivot to any position between the first position and the second position, such as by using a first luffing wire 82 and a second luffing wire 84. The boom 80 is depicted in the second position in FIGS. 1A-1B.

The first luffing wire 82 and the second luffing wire 84 can each connect to the boom 80 at one end and to the king post 78 at the opposite end. The first luffing wire 82 can engage a first turn down sheave 86 mounted to the king post 78. The second luffing wire 84 can engage a second turn down sheave 88 mounted to the king post 78. The first and second turn down sheaves 86 and 88 can be mounted to the king post 78 with a sheave mount 93*a*.

The first luffing wire 82 can extend from the first turn down sheave 86 to the first tensioner 90, which can function to apply and release tension to the first luffing wire 82. The amount of tension applied to the first luffing wire 82 can be an amount sufficient to hold the first telescoping soft yoke mooring arm 68 or greater. The second luffing wire 84 can extend from the second turn down sheave 88 to the second tensioner 91, which can function to apply and release tension to the second luffing wire 84. The amount of tension applied to the second luffing wire 84 can be an amount sufficient to hold the first telescoping soft yoke mooring arm 68 or greater.

For example, in operation the first and second tensioners 90 and 91 can be used to apply tension to the first and second luffing wires 82 and 84, allowing the boom 80 to be raised towards the first position with an upward movement away from any deck of a transport vessel. When the first and second tensioners 90 and 91 release tension from the first and second luffing wires 82 and 84, the boom 80 can be lowered towards the second position with a downward movement towards a surface of the sea and towards a deck of a transport vessel.

A jib 92 can be nested within the boom 80, allowing the jib 92 to have an extended position and a retracted position, and enabling the jib 92 to be telescopically contained within the boom 80. The jib 92 can be a tubular. The jib 92 can have a diameter ranging from about 12 feet to about 14 feet. The tubulars of the jib 92 can be made of hollow tubular steel.

The jib 92 can be controlled by at least one centralizing cylinder, such as a first centralizing cylinder 94 and a second centralizing cylinder 95.

The first and second centralizing cylinders 94 and 95 can control a position of the jib 92 within the boom 80. For example, the first and second centralizing cylinders 94 and 95 can be mounted in parallel on the opposite sides of the boom 80 to extend and retract the jib 92 within the boom 80.

The soft yoke 66 can connect between a floating gas processing station or the like and a transport vessel or the like. As such, the soft yoke 66 can be used to accommodate for environmental factors that can shift a position of the transport vessel, the floating natural gas processing station, the soft yoke 66, the like, or combinations thereof, to allow for continuous loading of liquefied natural gas, and to allow for safe transfer of people and equipment over a gangway formed using the soft yoke 66.

The soft yoke 66 can provide for higher levels of safety by maintaining safe distances using computer controlled devices between the transport vessel and the floating natural gas processing station and the like, and by providing for quick connects and emergency disconnects in case of fire, high winds, or rogue waves. The environmental factors can include wave motions, current motions, wind, transport vessel dynamics or the like, floating natural gas processing station dynamics or the like, changes in draft, and other such external and internal variables.

The first and second centralizing cylinders 94 and 95 can each be hydraulic or pneumatic cylinders, or combinations thereof, and can be connected to one or more accumulators 104*a*, 104*b*, 104*c*, and 104*d*. Any number of accumulators can be used.

The first and second centralizing cylinders 94 and 95 can extend and retract the jib 92 to maintain the transport vessel or the like at a nominal standoff position within preset limits from the floating natural gas processing station or the like.

The soft yoke 66 can prevent disconnection of any conduits communicating between the floating natural gas processing station and the transport vessel or the like, by maintaining the correct spacing therebetween.

Preset distances or limits from the floating natural gas processing station or the like can be any distance required for the particular application. The preset limits can be any allowable range of variation from the predefined distance required for the particular application. For example, in an application with a nominal distance of one hundred feet, and a preset limit of plus or minus ten feet, the first and second centralizing cylinders 94 and 95 can operate to extend and retract the jib 92 to maintain the nominal standoff position from about ninety feet to about one hundred ten feet. The nominal standoff position can be a length of the boom 80 plus a length of the jib 92 extending from the boom 80.

The soft yoke 66 can include conduits for flowing fluid between floating natural gas processing stations and transport vessels or the like. For example, the soft yoke 66 can include a yoke offload flexible conduit 98 and a yoke vapor return flexible conduit 99. The yoke offload flexible conduit 98 can be used to flow fluid, such as liquefied natural gas, from the floating natural gas processing stations to waiting transport vessels or the like. The fluid can be a liquefied natural gas or another liquid.

The yoke offload flexible conduit 98 can flow the fluid from the floating natural gas processing station into storage tanks on the transport vessel. The transport vessel can receive, store, transport, and offload the fluid.

The yoke vapor return conduit 99 can flow hydrocarbon vapor formed during offloading of the fluid back from the transport vessel to the floating natural gas processing station. For example, the yoke vapor return flexible conduit 99 can be in fluid communication with a station heat exchanger (shown in FIG. 5). The station heat exchanger can be a cold box, for receiving the formed vapor and cooling the vapor for reprocessing using a station mounted liquefaction train (also shown in FIG. 5). The hydrocarbon vapor can serve as a fuel supply for the floating natural gas processing station or the like.

The yoke offload flexible conduit 98 and the yoke vapor return conduit 99 can each be made from about eight inch to about ten inch diameter rigid pipe, or from a similar diameter flexible composite cryogenic hose, or combinations thereof. The yoke offload flexible conduit 98 and the yoke vapor return conduit 99 can be any size or material as required for the particular application, given particular flow rates, pressures, and storm conditions. For example, the yoke offload flexible conduit 98 and the yoke vapor return conduit 99 can be 3 inch or larger diameter reinforced hose, a draped hose, or a festooned hose.

The yoke offload flexible conduit 98 can have a jib flexible portion 109*a*, and the yoke vapor return flexible conduit 99 can have a jib flexible portion 109*b*. The jib flexible portions 109*a* and 109*b* can allow the yoke offload flexible conduit 98 and the yoke vapor return conduit 99 to move easily along with the boom 80 as the jib 92 expands and retracts within the boom 80. Since the boom 80 can be raised and lowered using the first and second tensioners 90 and 91, the jib flexible portions 109*a* and 109*b* can enable the yoke offload flexible conduit 98 and the yoke vapor return conduit 99 to have enough range of motion and flexibility to move with the boom 80 without fracturing or being over tensioned.

The yoke offload flexible conduit 98 can have a first rigid portion 110*a*, and the yoke vapor return flexible conduit 99 can have a second rigid portion 110*b*. The rigid portions 110*a* and 110*b* can provide a rigid connection between the yoke offload flexible conduit 98, the yoke vapor return conduit 99, and the boom 80, allowing the boom 80 to securely move the yoke offload flexible conduit 98 and the yoke vapor return conduit 99 as the boom 80 moves.

The yoke offload flexible conduit 98 and the yoke vapor return flexible conduit 99 can be secured to the boom 80, such as by gussets 105*a* and 105*b*, and support structures 114*a*, 114*b*, and 114*c*. Each support structure 114*a*, 114*b*, and 114 and gusset 105*a* and 105*b* can be pivotable and/or rotatable.

The soft yoke 66 can include one or more low pressure fluid accumulators 113*a*, 113*b*, 113*c*, and 113*d* for the first and second centralizing cylinders 94 and 95. The one or more low pressure accumulators 113*a*, 113*b*, 113*c*, and 113*d* can have a pressure from about 30 psi to about 300 psi each.

The soft yoke 66 can include a connection interface 103 for connecting the soft yoke 66 to the transport vessel or the like. For example, the connection interface 103 can be a primary quick connect/disconnect connector with a secondary emergency disconnect connector and a tertiary disconnect connector that engages a mooring socket on a transport vessel.

The soft yoke 66 can include a stop 404 configured to selectively engage a hydraulic actuator switch 404. For example, the stop 404 can be located on the boom 80, and the hydraulic actuator switch 403 can be located on the jib 92.

FIG. 1C depicts the boom 80 connected to the king post 78 with the first luffing wire 82. The first luffing wire 82 can hold the boom 80 in a first position 107. The second position 108 also is depicted. The boom 80 can be lowered to the second position 108. Also shown is the jib 92 and the jib flexible portion 109*a*.

Figure 2A:
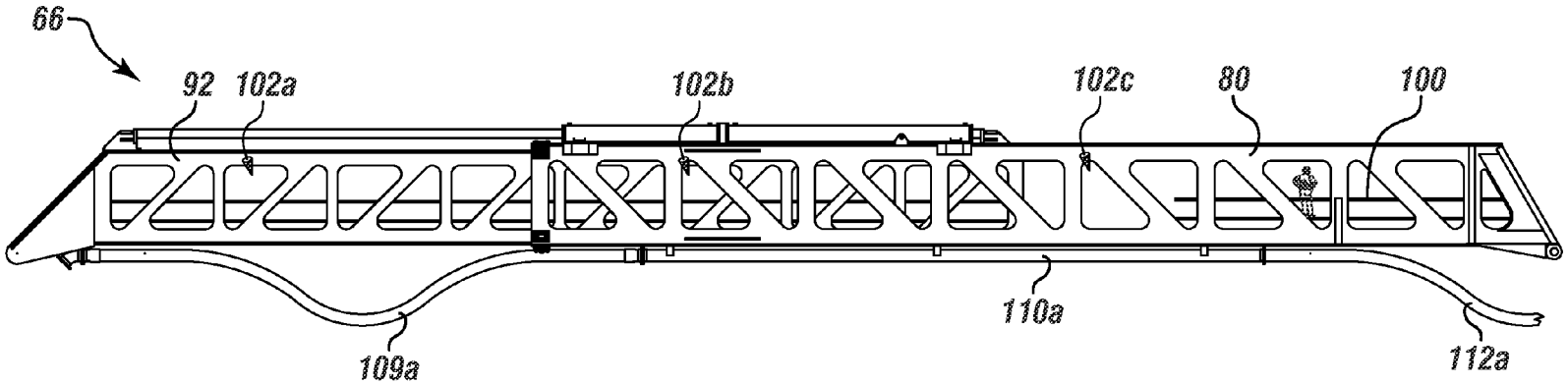
FIG. 2A depicts a side view of a portion of the soft yoke in an extended position.

FIG. 2A depicts the soft yoke 66 with the jib 92 and the boom 80 nested together. A secure enclosed gangway 100 can be formed that allows wind and water to pass through the secure enclosed gangway 100 without deforming, and allows people to pass between the transport vessel and the floating station or the like.

The secure enclosed gangway 100 can have openings 102*a*, 102*b*, and 102*c*, which can provide ventilation and allow spray and wind to pass through the secure enclosed gangway 100 without pulling a person into the sea.

The secure enclosed gangway 100 can function to allow for personnel to move between transport vessel and floating natural gas processing stations when the soft yoke 66 is connected therebetween. The secure enclosed gangway 100 can be made of aluminum, steel, or another material. The secure enclosed gangway 100 can have an anti-slip tread, handrails, lighting, and other safety features.

The jib 92 is depicted in a partially extended position relative to the boom 80 with the jib flexible portion 109*a* slightly tensioned as it connects to the rigid portion 110*a*. The rigid portion 110*a* is shown connected to the boom flexible portion 112*a*.

The boom flexible portion 112*a* can allow the conduits of the soft yoke 66 to move extend and retract along with the jib 92. For example, when the jib 92 is extended and retracted using the centralizing cylinders, the boom flexible portion 112*a* can provide the conduits with enough range of motion and flexibility to extend and retract with the jib 92 without fracturing or being over tensioned.

Figure 2B:
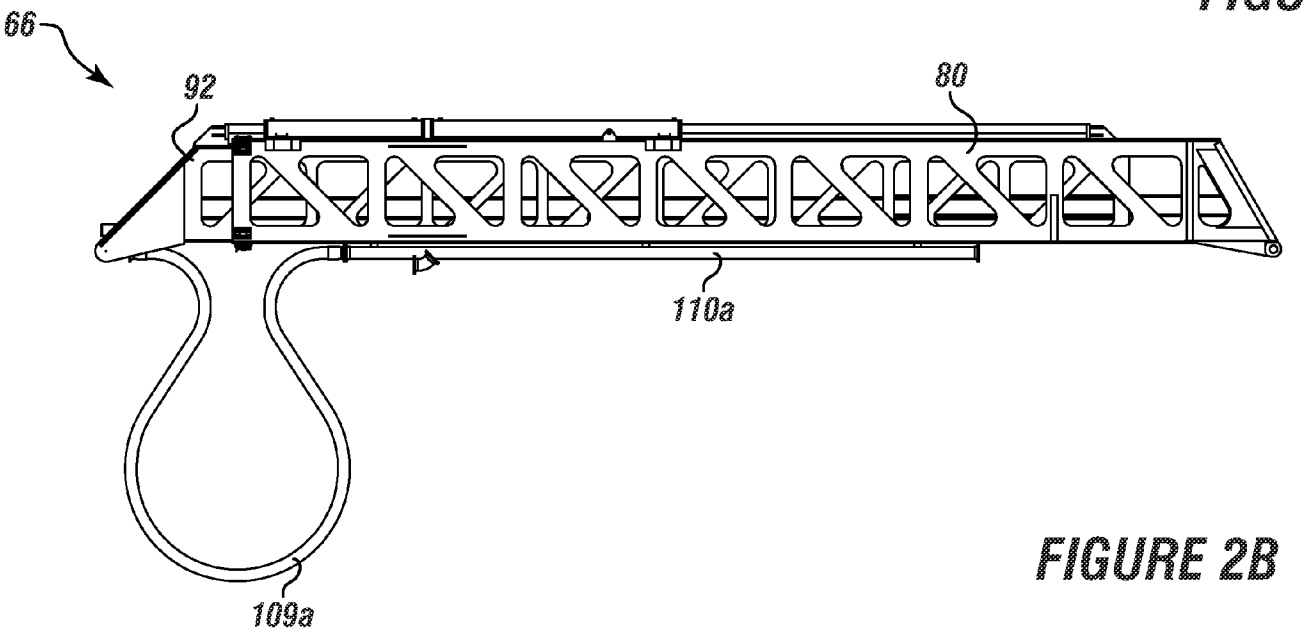
FIG. 2B depicts a side view of a portion of the soft yoke in a retracted position.

FIG. 2B depicts the same side view of a portion of the soft yoke 66 as FIG. 2A with the jib 92 depicted in a retracted position relative to the boom 80. The jib flexible portion 109*a* is depicted connected to the rigid portion 110*a*, with little or no tension, having an extra "scope" or lengths in a loop.

The jib flexible portion 109*a* is configured to have a length sufficient to have enough range of motion and flexibility to extend and retract along with the jib 92. The boom flexible portion can be configured the same as the jib flexible portion 109*a*, and can function in the same manner.

Figure 2C:
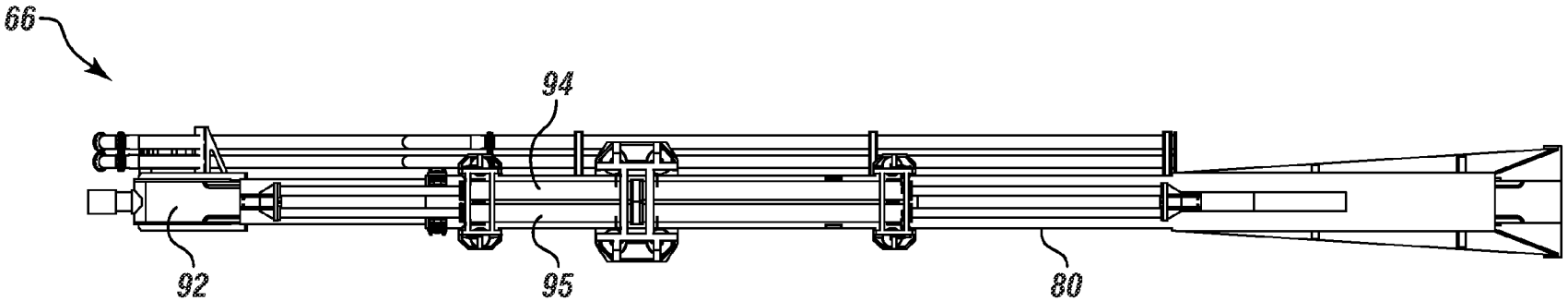
FIG. 2C depicts a top view of a portion of the soft yoke in the extended position.

FIG. 2C depicts a top view of a portion of the soft yoke 66 having the first and second centralizing cylinders 94 and 95 configured to actuate for extending and retracting the jib 92 relative to the boom 80.

Figure 3A:
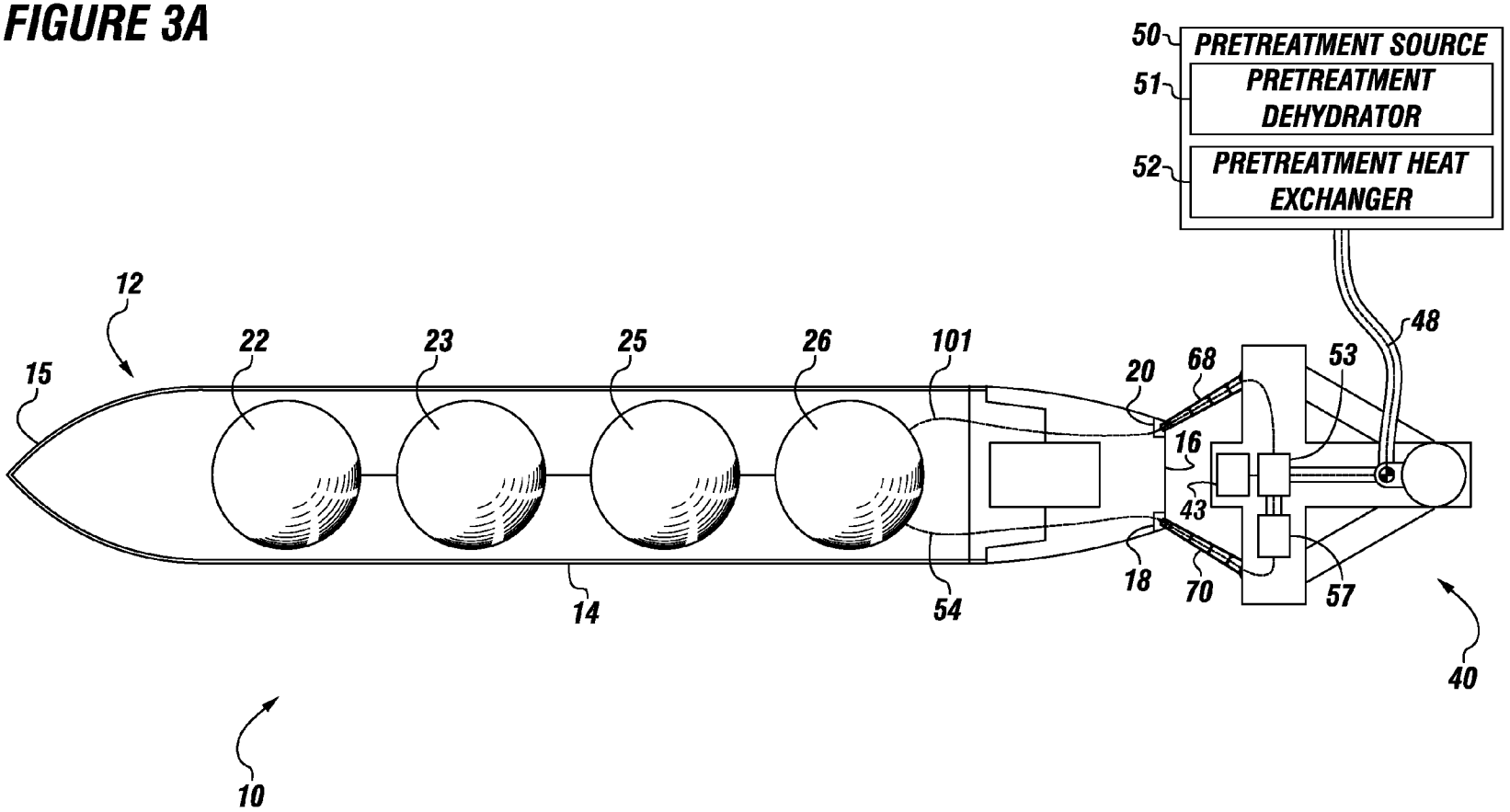
FIG. 3A depicts two soft yoke mooring arms connecting between a floating station and a transport vessel.

FIG. 3A depicts a top view of a system 10 with the first telescoping soft yoke mooring arm 68 and a second telescoping soft yoke mooring arm of 70 connecting the floating natural gas processing station 40 to a transport vessel 12. The transport vessel 12 can have a vessel hull 14 between a bow 15 and stern 16. The floating natural gas processing station 40 is depicted as a semisubmersible structure.

In one or more embodiments, the first and second telescoping soft yoke mooring arms 68 and 70 can connect directly to the stern 16 of the transport vessel 12, with the first and second telescoping soft yoke mooring arms 68 and 70 both angled inwards towards the stern 16. First and second mooring sockets 18 and 20 can connect the first and second telescoping soft yoke mooring arms 68 and 70 to stern 16.

A station heat exchanger 53 can be connected to a pretreatment source 50 for receiving dry gas 48 from the pretreatment source 50.

The pretreatment source 50 can have a pretreatment dehydrator 51 and a pretreatment heat exchanger 52. Accordingly, the pretreatment source 50 can be configured to cool and dry natural gas from a wellbore or other source.

The liquefied natural gas 54 can flow from station offload flexible conduits, which are also termed "offload flexible conduits" herein, through the yoke offload conduits to liquefied natural gas storage tanks 22, 23, 25, and 26 on the transport vessel 12.

A hydrocarbon vapor 101 can flow from the transport vessel 12, through yoke vapor return flexible conduits, through station vapor return flexible conduits, and to the station heat exchanger 53.

A station controller 43 can be located on the floating natural gas processing station 40 to control one or more components thereof. The floating natural gas processing station 40 can include one or more liquefaction trains 57 in communication with the station heat exchanger 53.

Figure 3B:
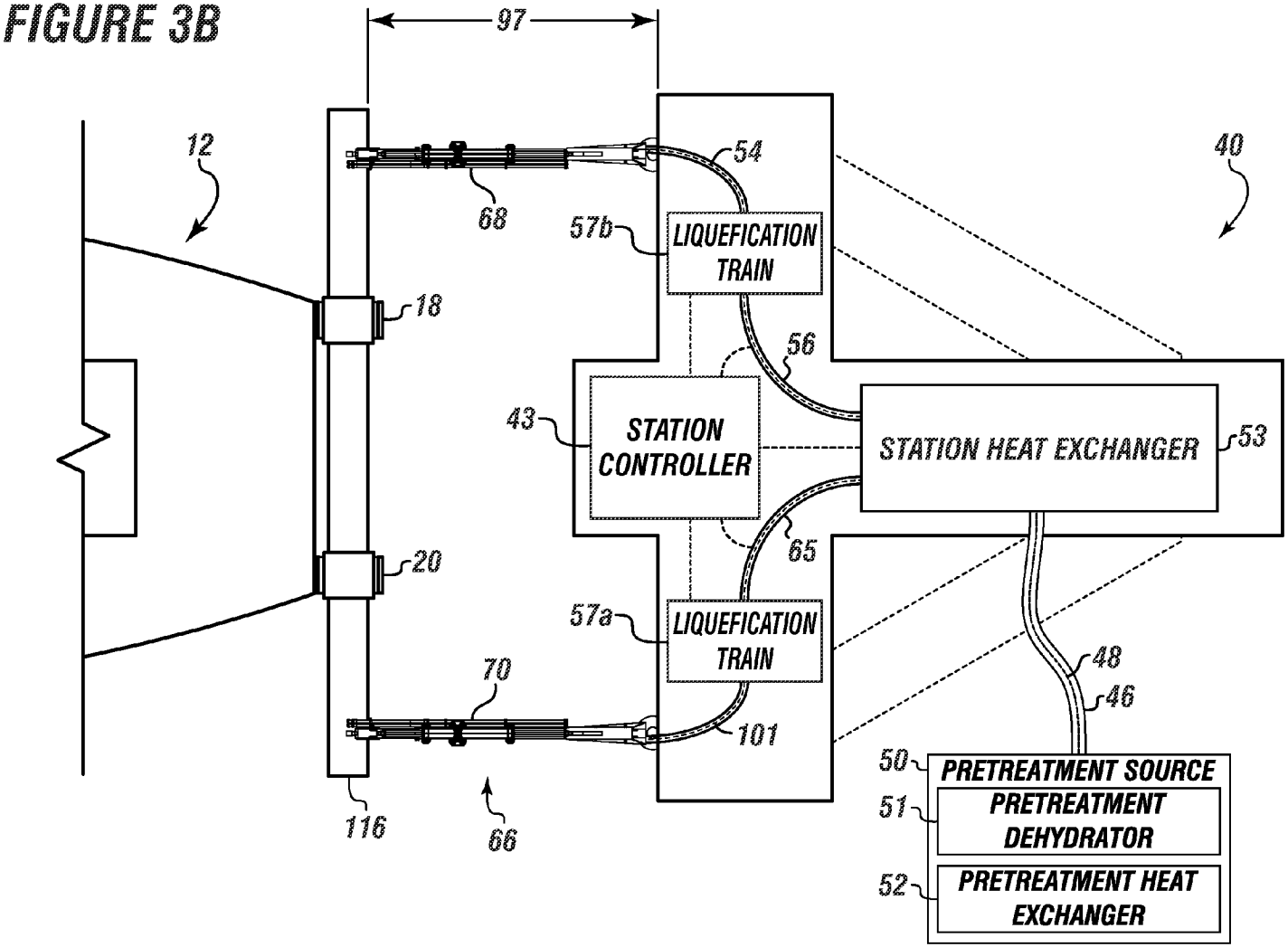
FIG. 3B depicts two soft yoke mooring arms connected to a docking bar removably connected to a transport vessel.

FIG. 3B depicts an embodiment of a floating natural gas processing station 40 connected to a transport vessel 12 using the soft yoke 66 with a first telescoping soft yoke mooring arm 68 and a second telescoping soft yoke mooring arm 70 connected to a docking bar 116. The docking bar 116 can connect to the transport vessel 12 via first and second morning sockets 18 and 20.

The station controller 43 can control flow of liquefied natural gas 54, hydrocarbon vapor 101, and can control the station heat exchanger 53.

The transport vessel 12 can be positioned at a nominal standoff position 97 relative to the floating natural gas processing station 40. In one or more embodiments, the first and second telescoping soft yoke mooring arms 68 and 70 can be connected directly to the transport vessel 12 or to the docking bar 116, allowing versatility of connection for vessels with small narrow sterns, and for vessels with larger, wider sterns.

The pretreatment source 50 can communicate with the station heat exchanger 53 via inlet conduit 46, allowing dry gas 48 to flow to the station heat exchanger 53 after passing through the pretreatment heat exchanger 52 and the pretreatment dehydrator 51.

The liquefied natural gas 54 can flow from the floating natural gas processing station 40, through an offload flexible conduit 56 and through corresponding yoke offload flexible conduits on the soft yoke 66 to the transport vessel 12.

The hydrocarbon vapor 101 can return from the transport vessel 12 through yoke vapor return flexible conduits on the soft yoke and through a corresponding vapor return flexible conduit 65 on the floating natural gas processing station 40.

The liquefaction trains 57*a* and 57*b* can functions to cool the station heat exchanger 53. The liquefied natural gas 54 and the hydrocarbon vapor 101 can flow through the liquification trains 57*a* and 57*b* between the transport vessel 12 and the station heat exchanger 53.

Figure 4A:
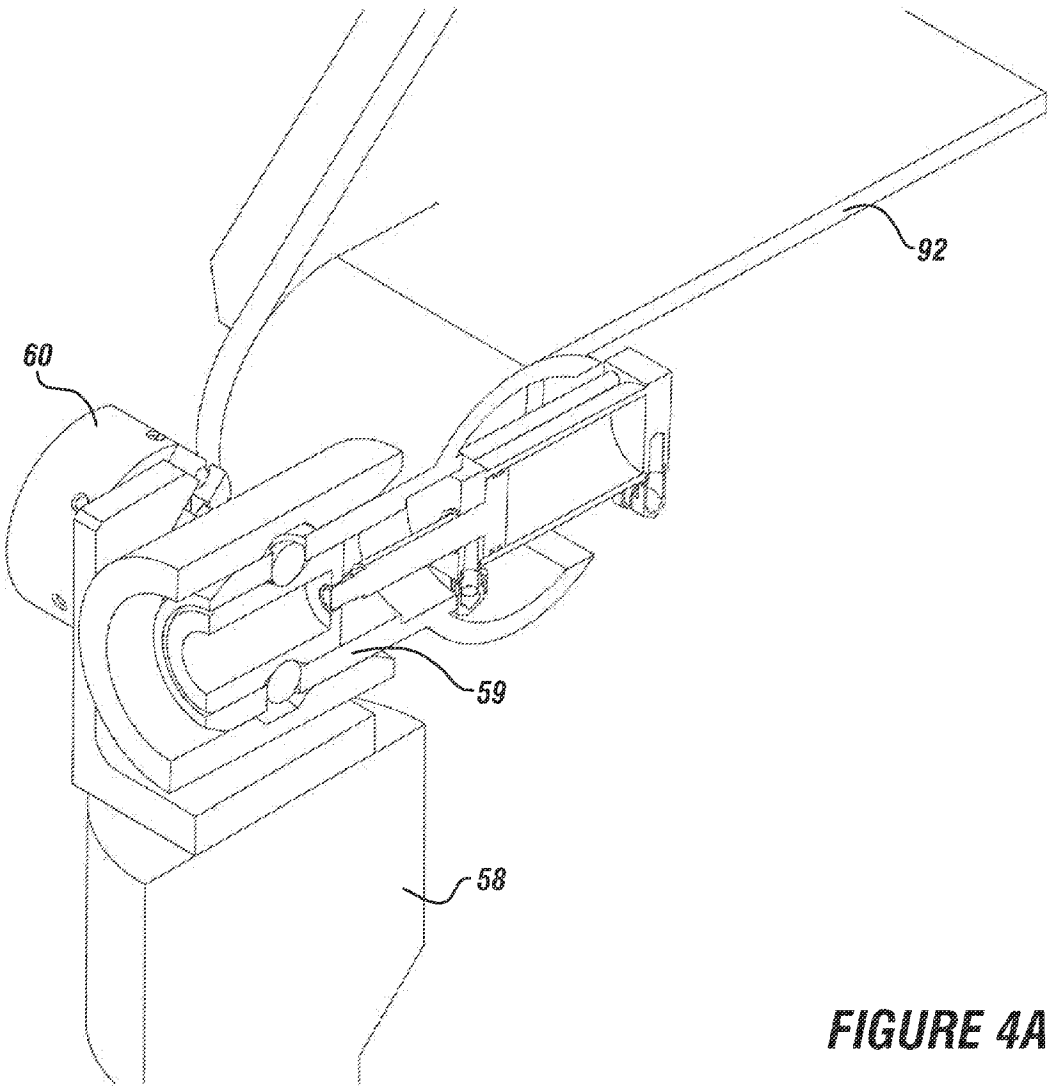
FIG. 4A depicts a cut away view of a secondary emergency disconnect connector along with a primary quick release connector and a tertiary emergency disconnect release connector.

FIG. 4A shows the three connectors usable with the system, the primary quick connect/disconnect connector 58, the secondary emergency disconnect connector 59 and the tertiary emergency disconnect connector 60 that connect to the jib 92.

The primary quick connect/disconnect connector 58 can engage a mooring socket on the transport vessel. Hydraulic cylinders can force the quick connect/disconnect connector 58 into the mooring socket.

Figure 4B:
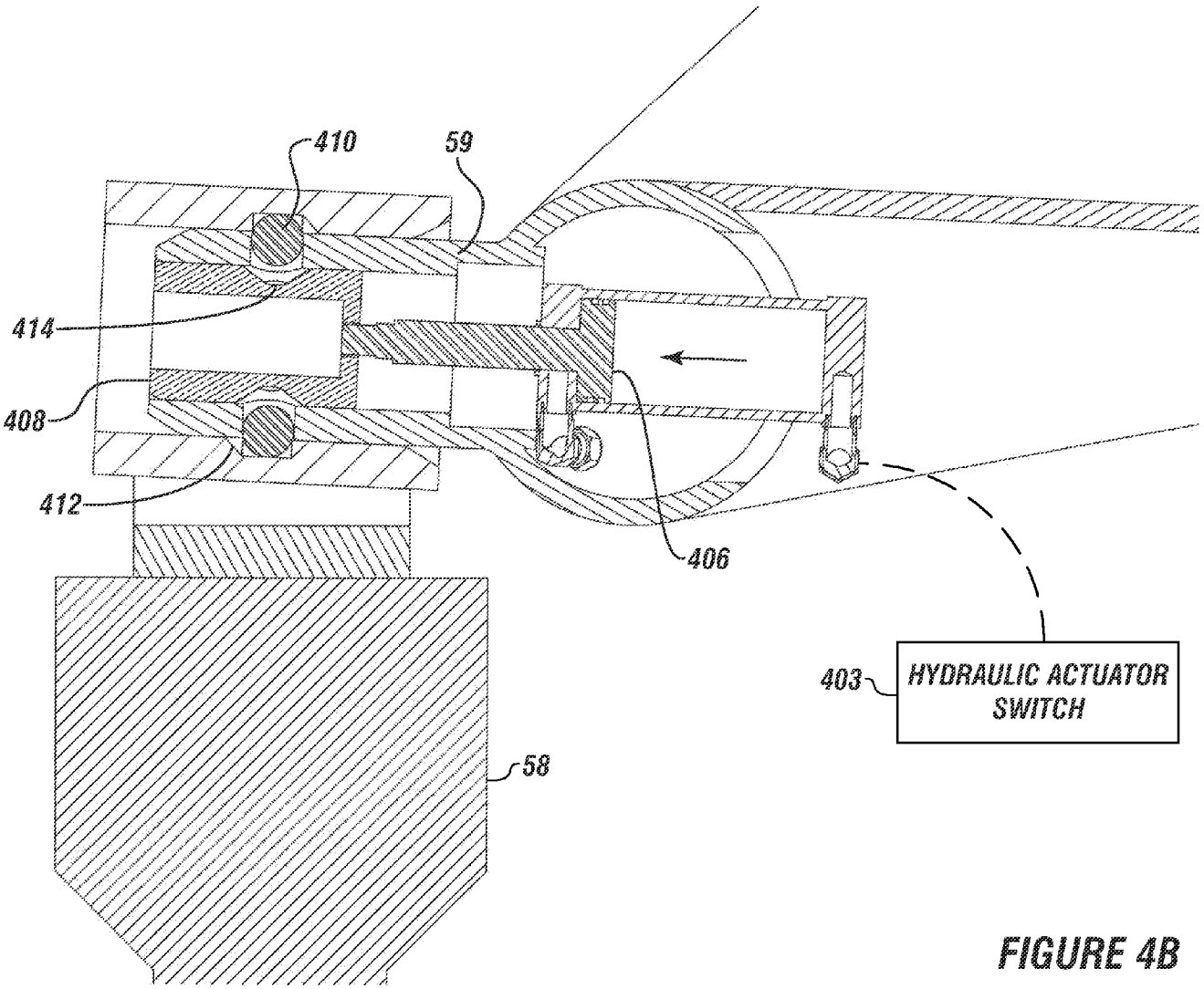
FIG. 4B shows a detailed view of the secondary emergency disconnect connector.

FIG. 4B depicts in detail the secondary emergency disconnect connector 59 engaging between the tip of the jib and a first lock release 408 to allow the jib and boom assembly to disconnect and slide away from the primary quick connect/disconnect connector 58.

The secondary emergency disconnect connector 59 can be operatively engaged with an emergency actuator 406, which can be operatively engaged with a hydraulic actuator switch 403. The first lock release 408 can have a pin recess 414 for operatively engaging the emergency actuator 406. Quick release bearings 410 can be disposed between the first lock release 408 and a locking recess sleeve 412.

In operation, the secondary emergency disconnect connector 59 can connect the soft yoke to the transport vessel. A stop can be configured to engage the hydraulic actuator switch 403 when the jib has reached a maximum extension length relative to the boom. The hydraulic actuator switch 403 can be configured to flow hydraulic fluid to the hydraulic actuator 406 upon engagement with the stop. The hydraulic actuator 406 can receive the flowing fluid from the hydraulic actuator switch 403. The hydraulic actuator 406 can push the first lock release 408 upon receipt of the fluid from the hydraulic actuator switch 403.

The first lock release 408 can then disengage the quick release bearings 410 and release the telescoping soft yoke mooring arms from the transport vessel. The quick release bearings 410 move from being engaged within a locking recess sleeve 412 to within a pin recess 414, thereby releasing the soft yoke from the transport vessel.

Figure 5:
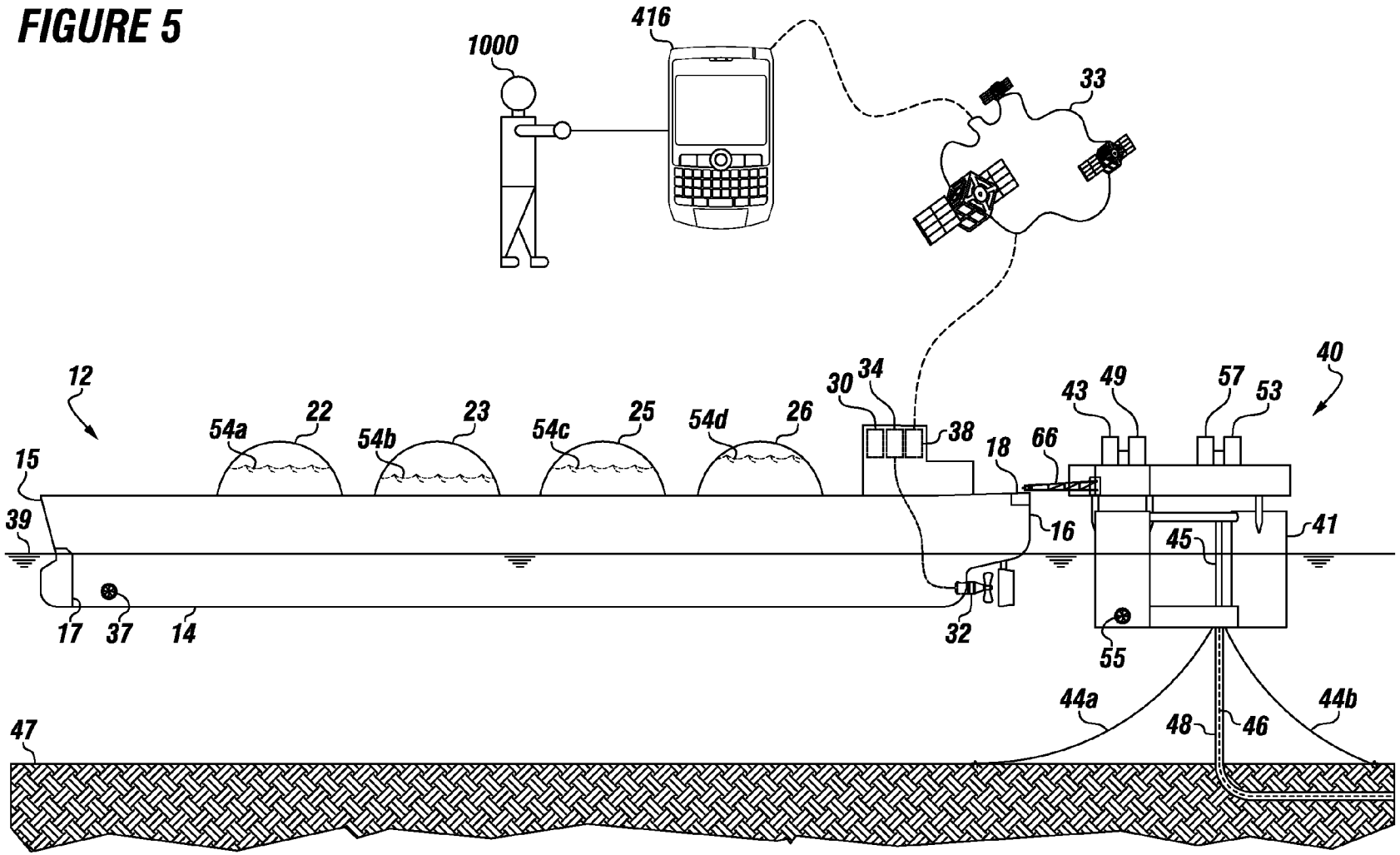
FIG. 5 depicts a soft yoke connecting between a transport vessel and a floating station along with a user in communication with a network.

FIG. 5 depicts a floating natural gas processing station 40 with a soft yoke 66 and a spread moored turret 45. The spread moored turret 45 can be moored to the sea bed 47 with mooring lines 44*a* and 44*b*.

A dry gas inlet conduit 46 can extend into the spread moored turret 45 for communicating dry gas 48 from a pretreatment source for processing on the floating natural gas processing station 40 with a natural gas liquefaction train 57.

The spread moored turret 45 allows the floating natural gas processing station 40 to weather vane according to weather conditions, wind direction, and waves. For example, the spread moored turret 45 allows the floating natural gas processing station 40 to pivot and/or rotate about the spread moored turret 45, while the spread moored turret 45 is fixed by the mooring lines 44*a* and 44*b*.

The floating natural gas processing station 40 can be a ballasted floating vessel with a station hull 41 with a station variable draft.

In embodiments, the floating natural gas processing station 40 can use heading controls 49 connected to thrusters 55, allowing the floating natural gas production station 40 to dynamically maintain position with the transport vessel 12 using GPS positioning with other dynamic positioning equipment to maintain space between the floating natural gas processing station 40 and the transport vessel 12.

A vessel controller 43 can be connected to the heading controls 49 and the station thrusters 55.

The stern 16 of the transport vessel 12 can connect directly to the boom of the soft yoke 66. For example, a first mooring socket 18 can connect to the soft yoke 66. Pivot can be employed with the soft yoke 66 to rotate the mooring arms of the soft yoke 66, allowing the liquefied natural gas 54*a*, 54*b*, 54*c*, and 54*d* to flow into the storage tanks 22, 23, 25, and 26 from the natural gas liquefaction train 57 and/or the station heat exchanger 53.

The transport vessel 12 is shown having a hull 14 with a variable draft 17, allowing the transport vessel 12 to change draft and balance with respect to sea level 39 to be capable of receiving and offloading the processed liquefied natural gas 54*a*-54*d*.

The transport vessel 12 can have a bow 15 opposite the stern 16, with the storage tanks 22, 23, 24, 25, and 26 located on the hull 14. The storage tanks 22, 23, 24, 25 and 26 can be independent of each other.

The transport vessel 12 can include a vessel controller 30 with a processor and data storage for monitoring data associated with the receipt of the processed liquefied natural gas 54*a*-54*d*, the storage of the processed liquefied natural gas 54*a*-54*d*, and the offloading the processed liquefied natural gas 54*a*-54*d* from the transport vessel 12.

The transport vessel 12 can include a propulsion system 32 for moving the transport vessel 12 and a navigation system 34 for controlling the propulsion system 32.

The transport vessel 12 can have a station keeping device 38 that operates dynamic positioning thrusters 37. The station keeping device 38 and the navigation system 34 can communicate with a network 33, shown here as a satellite network, for dynamic positioning of the floating vessel 12. Client devices 416 with computer instructions can communicate with the network 33, allowing a remote user 1000 to monitor the processing, storage, and offloading.

Figure 6A:
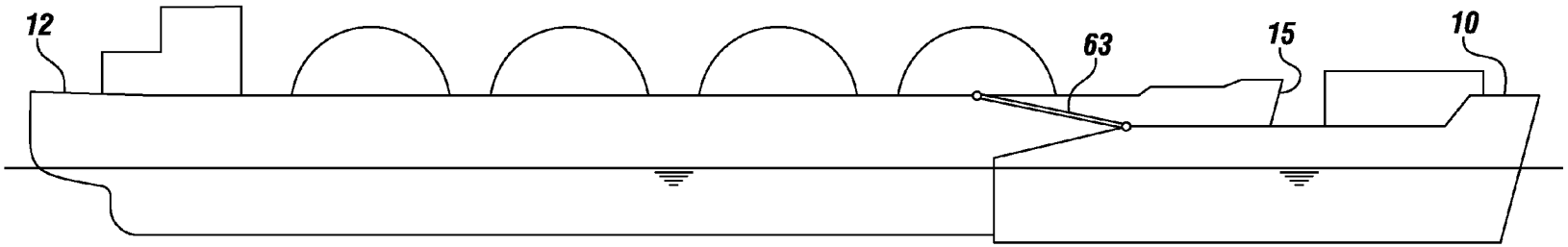
FIG. 6A depicts a side view of a transport vessel connected to a floating station using a docking notch and at least one mooring arm.
Figure 6B:
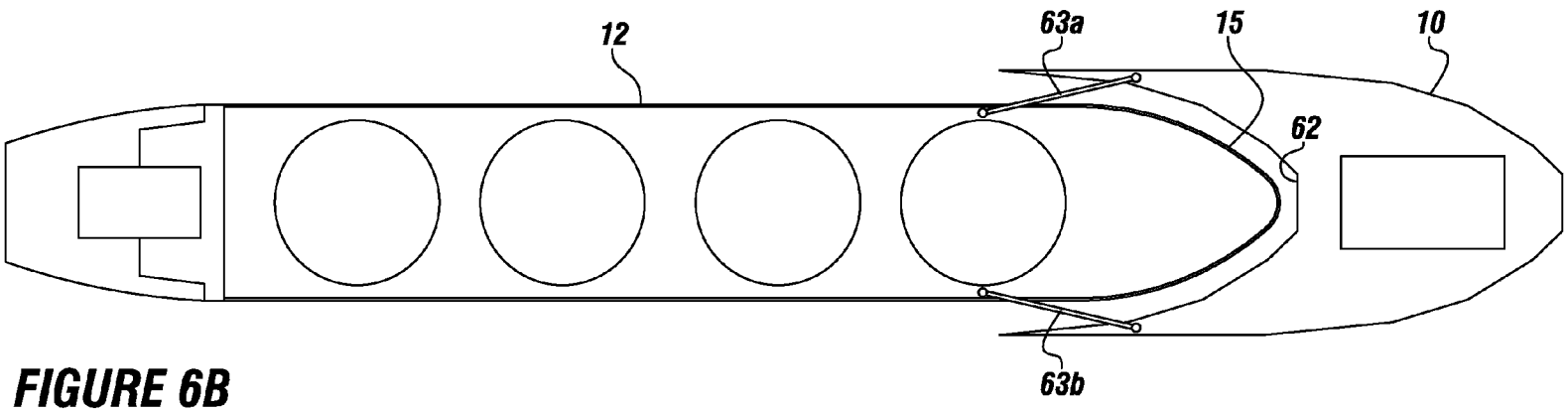
FIG. 6B depicts a top view of the embodiment of FIG. 6A.

FIGS. 6A and 6B depict an embodiment for connecting a transport vessel 12 and a floating natural gas processing station 10. The floating natural gas processing station 10 is depicted as a floating vessel without propulsion, such as a barge. The floating natural gas processing station 10 can have a docking notch 62 for accepting the bow 15 of the transport vessel 12. Mooring arms 63, 63*a*, and 63*b* are shown connected to the station hull of the floating natural gas processing station 10 for holding the transport vessel 12 in the docking notch 62.

The floating natural gas processing station 10 can have a station variable draft and can be ballasted like the transport vessel 12.

Figure 7:
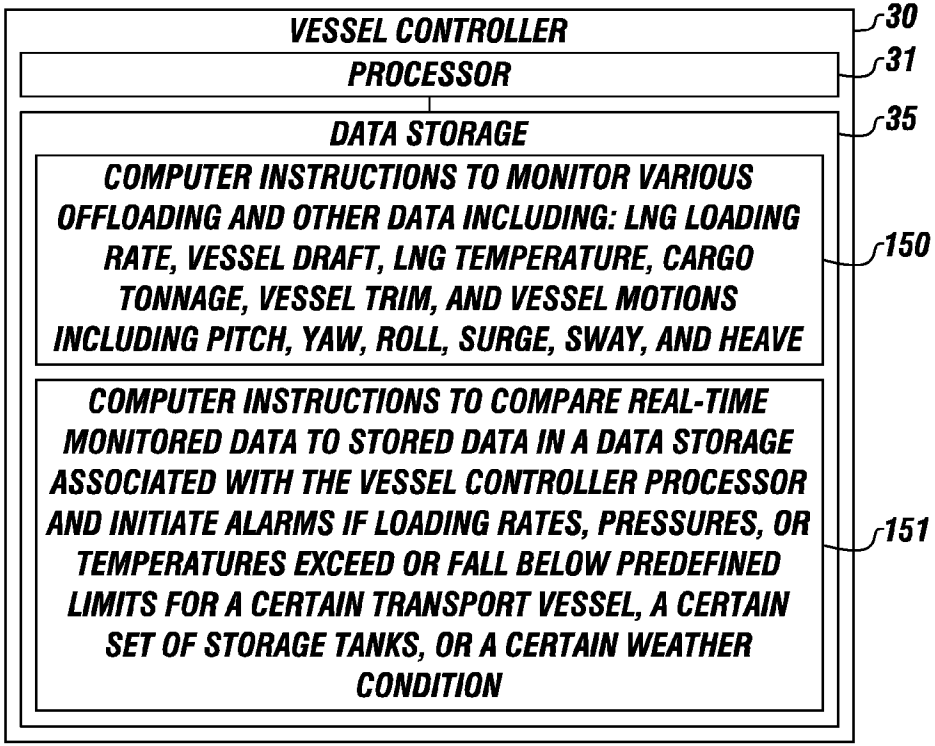
FIG. 7 depicts an embodiment of a vessel controller.

FIG. 7 depicts an embodiment of a vessel controller 30 with a processor 31 and a data storage 35.

The data storage 35 can have computer instructions 150 to monitor various offloading and other data including: LNG loading rate, vessel draft, LNG temperature, cargo tonnage, vessel trim, and vessel motions including pitch, yaw, roll, surge, sway, and heave.

The data storage 35 can have computer instructions 151 to compare real-time monitored data to stored data in a data storage associated with the vessel controller processor and initiate alarms if loading rates, pressures, or temperatures exceed or fall below predefined limits for a certain transport vessel, a certain set of storage tanks, or a certain weather condition.

Figure 8:
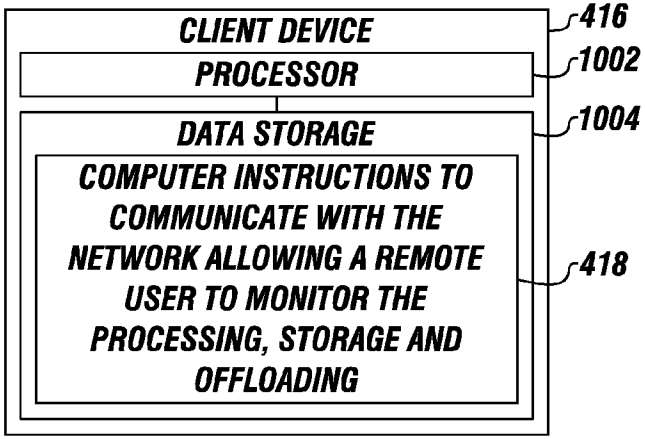
FIG. 8 depicts an embodiment of a client device.

FIG. 8 depicts an embodiment of a client device 416 with a processor 1002 and a data storage 1004. The data storage 1004 can have computer instructions 418 to communicate with the network allowing a remote user to monitor the processing, storage and offloading.

While these embodiments have been described with emphasis on the embodiments, it should be understood that within the scope of the appended claims, the embodiments might be practiced other than as specifically described herein.

What is claimed is:

1. A floating natural gas processing station for receiving dry gas, forming liquefied natural gas, and offloading the liquefied natural gas safely, the floating natural gas processing station comprising:

a. a station hull with a station variable draft;

b. a plurality of mooring lines, connecting the station hull to a seabed;

c. a dry gas inlet conduit for receiving a dry gas from a pretreatment source;

d. a station heat exchanger for cooling the dry gas;

e. a liquefaction train supported by the station hull for cooling the station heat exchanger, wherein the station heat exchanger forms a liquefied natural gas;

f. an offload flexible outlet conduit for flowing the liquefied natural gas from the station heat exchanger;

g. a vapor return flexible conduit for communicating hydrocarbon vapor formed during offloading from a transport vessel to the floating natural gas processing station, wherein the vapor return flexible conduit communicates with the station heat exchanger;

h. a primary quick connect/disconnect connector and a secondary emergency disconnect connector and a tertiary emergency disconnect connector to allow quick connect/disconnect or emergency disconnect of the floating natural gas processing station from the transport vessel;

i. a station controller for monitoring the dry gas inlet conduit, the station heat exchanger, and the offload flexible outlet conduit, and for actuating the primary quick connect/disconnect connector, the secondary emergency disconnect connector, and the tertiary emergency disconnect connector; and j. at least two telescoping soft yoke mooring arms connected to the station hull, wherein each telescoping soft yoke mooring arm comprises:

(i) an upper connecting mount for connecting the upper connecting mount to the floating natural gas processing station;

(ii) a lower connecting mount for connecting the upper connecting mount to the floating natural gas processing station;

(iii) a turn table connected to the lower connecting mount;

(iv) a king post engaged with the turn table and the upper connecting mount;

(v) a boom connected to the turn table and to at least one luffing wire, wherein each luffing wire engages a turn down sheave mounted to the king post;

(vi) a tensioner for each luffing wire;

(vii) a jib telescopically and slidably contained within the boom connected to at least one centralizing cylinder for controlling a position of the jib within the boom as the floating natural gas processing station and the transport vessel are affected by wave motion, current motion, wind motion, transport ship dynamics, floating natural gas processing station dynamics, or combinations thereof, wherein the jib assists in maintaining a nominal standoff position by holding the transport vessel at a predefined distance from the floating natural gas processing station, and wherein the boom and the jib form a gangway for moving personnel between the transport vessel and the floating natural gas processing station;

(viii) a yoke offload flexible conduit for flowing the liquefied natural gas from the offload flexible outlet conduit of the floating natural gas processing station to the transport vessel; and (ix) a yoke vapor return flexible conduit for flowing the vapor from the transport vessel to the vapor return flexible conduit of the floating natural gas processing station.

2. The floating natural gas processing station of claim 1, wherein the at least one centralizing cylinder is a pneumatic cylinder connected to an accumulator.

3. The floating natural gas processing station of claim 1, wherein the boom is pivotably connected to the turn table.

4. The floating natural gas processing station of claim 3, wherein the boom is pivotably connected to the turn table with at least one heel pin.

5. The floating natural gas processing station of claim 1, wherein the plurality of mooring lines connect the station hull to the seabed at a spread moored turret that allows the floating natural gas processing station to weather vane according to weather conditions, wind direction, and wave direction.

6. The floating natural gas processing station of claim 1, wherein the station hull is a semisubmersible hull.

7. The floating natural gas processing station of claim 1, further comprising a docking notch for accepting a bow of the transport vessel, wherein each telescoping soft yoke mooring arm holds the transport vessel within the docking notch.

8. The floating natural gas processing station of claim 1, wherein each telescoping soft yoke mooring arm is made of steel or aluminum.

9. The floating natural gas processing station of claim 1, wherein the turn table is configured to rotate about the king post.

10. The floating natural gas processing station of claim 1, wherein the boom is configured to pivot from a first position to a second position, and to any position between the first position and the second position.

11. The floating natural gas processing station of claim 1, wherein each tensioner is configured to apply and release tension to one of the luffing wires to raise and lower the boom.

12. The floating natural gas processing station of claim 1, wherein at least one of the centralizing cylinders is configured to slidingly extend and retract the jib.

13. The floating natural gas processing station of claim 1, wherein the yoke offload flexible conduit and the yoke vapor return flexible conduit each comprise:

a. a jib flexible portion allowing the yoke offload flexible conduit and the yoke vapor return flexible conduit to move with the boom;

b. a rigid portion providing a rigid connection between the yoke offload flexible conduit and the yoke vapor return flexible conduit and the boom, and further allowing the boom to securely move the yoke offload flexible conduit and the yoke vapor return flexible conduit as the boom moves; and c. a boom flexible portion allowing the yoke offload flexible conduit and the yoke vapor return flexible conduit to extend and retract along with the jib.

14. The floating natural gas processing station of claim 1, wherein the station hull is at least a three column connected hull.

15. The floating natural gas processing station of claim 1, wherein the dry gas cooled in a pretreatment heat exchanger prior to flowing the dry gas to the floating natural gas processing station.

16. The floating natural gas processing station of claim 1, wherein the station heat exchanger is a cold box or a spiral wound heat exchanger for cryogenic cooling of the dry gas.

17. The floating natural gas processing station of claim 1, further comprising station thrusters mounted to the floating natural gas processing station and connected to heading controls for dynamically positioning the floating natural gas processing station relative to the transport vessel.

18. The floating natural gas processing station of claim 1, further comprising using a docking bar for securing to a stern of the transport ship enabling the telescoping soft yoke mooring arms to hold the transport vessel at a predetermined distance from the floating natural gas processing station.

19. The floating natural gas processing station of claim 1, wherein the secondary disconnect connector comprises:

a. a hydraulic actuator switch disposed on the boom;

b. a stop disposed on the jib configured to engage the hydraulic actuator switch when the jib has reached a maximum extension length relative to the boom, wherein the hydraulic actuator switch is configured to flow hydraulic fluid to a hydraulic actuator upon engagement with the stop, and wherein the hydraulic actuator pushes the first lock release upon receipt of the hydraulic fluid from the hydraulic actuator switch; and c. quick release bearings, wherein the first lock release disengages the quick release bearings and releases the telescoping soft yoke mooring arms from the transport vessel.

20. The floating natural gas processing station of claim 1, wherein the tertiary emergency disconnect connector is in communication with the secondary emergency disconnect connector for providing additional quick release of the transport vessel from the floating natural gas processing station.

* * * * *